US010407867B2

(12) United States Patent
Wyss et al.

(10) Patent No.: US 10,407,867 B2
(45) Date of Patent: Sep. 10, 2019

(54) HYDRAULIC LIFT CYLINDER MOUNTING ARRANGEMENT FOR TRACK-TYPE TRACTORS

(71) Applicant: Caterpillar Inc., Peoria, IL (US)

(72) Inventors: Jacob Carl Wyss, Eureka, IL (US); Christopher R. Beasley, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 146 days.

(21) Appl. No.: 15/189,550

(22) Filed: Jun. 22, 2016

(65) Prior Publication Data

US 2017/0370070 A1 Dec. 28, 2017

(51) Int. Cl.
*E02F 3/76* (2006.01)
*E02F 3/84* (2006.01)

(52) U.S. Cl.
CPC ..... *E02F 3/844* (2013.01); *E02F 3/7609* (2013.01); *E02F 3/7618* (2013.01); *E02F 3/76* (2013.01)

(58) Field of Classification Search
CPC ..... E02F 3/76; E02F 3/7609
USPC ..... 172/811, 812, 825, 789, 795; 37/235, 37/236
See application file for complete search history.

(56) References Cited

U.S. PATENT DOCUMENTS

| | | | | |
|---|---|---|---|---|
| 3,515,224 | A * | 6/1970 | Seaberg | E02F 3/844 172/666 |
| 3,631,930 | A | 1/1972 | Peterson | |
| 3,800,885 | A | 4/1974 | Gianessi | |
| 4,320,589 | A | 3/1982 | Pelazza | |
| 4,802,537 | A | 2/1989 | Ryerson | |
| 5,467,829 | A | 11/1995 | Barton et al. | |
| 5,682,955 | A | 11/1997 | Groth et al. | |
| 6,105,682 | A | 8/2000 | Recker et al. | |
| 6,497,059 | B1 * | 12/2002 | Downer, Jr. | E02F 3/308 172/828 |
| 6,874,582 | B2 | 4/2005 | Hollinrake et al. | |
| 7,174,968 | B2 * | 2/2007 | Okunishi | E02F 3/964 172/819 |
| 7,637,039 | B2 * | 12/2009 | Toda | E02F 9/2235 37/195 |
| 7,717,205 | B2 * | 5/2010 | Kertz | B60K 13/04 180/68.1 |
| 2007/0079977 | A1 | 4/2007 | Defrancq | |
| 2008/0121451 | A1 | 5/2008 | Kertz et al. | |

* cited by examiner

*Primary Examiner* — Gary S Hartmann
(74) *Attorney, Agent, or Firm* — Miller, Matthias & Hull

(57) ABSTRACT

A track-type tractor may comprise an operator cab, an engine, a frame supporting the operator cab and the engine, and an implement configured to move a load. The track-type tractor may further comprise at least one hydraulic lift cylinder configured to raise and lower the implement. The hydraulic lift cylinder may include a head end, a rod end, and a cylinder barrel. The cylinder barrel may be connected to the backside of the implement, and the rod end may be connected to the frame.

20 Claims, 5 Drawing Sheets

HYDRAULIC LIFT CYLINDER MOUNTING ARRANGEMENT FOR TRACK-TYPE TRACTORS

TECHNICAL FIELD

The present disclosure generally relates to track-type tractors and, more specifically, to mounting arrangements and operation methods for hydraulic lift cylinders that raise and lower an implement associated with such machines.

BACKGROUND

Track-type tractors may have an implement that moves a load such as soil, sand, rubble, construction materials, and other materials. One example is a bulldozer that includes a blade mounted on a front end of the machine for pushing, carrying, and moving a variety of loads. Tilt cylinders may be used to adjust the side-to-side tilt angle and the forward to back tilt angle (or pitch) of the blade, while one or more hydraulic lift cylinders may be used to raise and lower the blade as needed for moving the loads. Hydraulic lift cylinders may include a cylinder barrel that houses a piston rod. The head of the piston may be oriented toward the "head end" of the hydraulic lift cylinder, and the piston rod may extend to the "rod end" of the hydraulic lift cylinder.

Traditionally, the cylinder barrel is mounted high on a large elevated support structure, such as a radiator guard, that is attached to the front of the frame of the machine, while the piston rod is connected relatively low on the blade. Raising of the blade is carried out by contraction of the hydraulic lift cylinders, whereby hydraulic fluid flows into the rod end and applies pressure on the lower lip of the piston head (rod end pressure) to cause cylinder contraction. In a particular application known as pryout, this action is used to lift a bulk of material out of the ground in order to push it. In contrast, lowering of the blade is carried out by extension of the hydraulic lift cylinders, whereby hydraulic fluid flows into the head end and applies pressure on the piston head (head end pressure) to push the piston down through the cylinder barrel and cause cylinder extension. This action is used to force the blade edge into the ground, allowing the machine to dig and accumulate material.

However, the current mounting arrangement for hydraulic lift cylinders has many drawbacks. For one, it operates through cylinder contraction (rod end pressure) to raise the blade which has less capacity to generate force than cylinder extension (head end pressure). Cylinder extension has considerably greater capacity to generate force because the hydraulic fluid applies pressure to the upper surface of the piston head which has more surface area to act on than the lower lip of the piston head that is pressurized during cylinder contraction. Furthermore, those skilled in the art will appreciate that a bulldozer mechanism has its least mechanical advantage during blade lift. Thus, minimum mechanical advantage is combined with minimum cylinder capacity during blade lift in the current mounting arrangement. In order to meet pryout load requirements, the hydraulic system must be designed to be unnecessarily large for other blade movements. In addition, the elevated support structure used to mount the hydraulic lift cylinders results in a large bending moment on the frame, as well as a convoluted load path from the hydraulic lift cylinders to the support structure and the frame. Moreover, the large elevated support structure hinders access to the front of the engine. Even further, expensive and high-level machining is often needed for establishing the connections between the elevated support structure and the frame.

An alternative hydraulic lift cylinder mounting arrangement is described in U.S. Pat. No. 4,320,539. Specifically, the patent discloses hydraulic rams disposed between a frame supporting a snow-clearing blade on the front of a vehicle and a plate on the backside of the snow-clearing blade. Although effective, the hydraulic rams are not directly mounted to the frame of the vehicle, but to a separate frame that connects the vehicle to the snow-clearing blade. Thus, there is a need for improved hydraulic lift cylinder mounting arrangements for track-type tractors such as bulldozers.

SUMMARY

In accordance with one aspect of the present disclosure, a track-type tractor is disclosed. The track-type tractor may comprise an operator cab, an engine, a frame supporting the operator cab and the engine, and an implement configured to move a load. The track-type tractor may further comprise at least one hydraulic lift cylinder configured to raise and lower the implement. The hydraulic lift cylinder may include a head end, a rod end, and a cylinder barrel. The cylinder barrel may be connected to a backside of the implement and the rod end may be connected to the frame.

In accordance with another aspect of the present disclosure, a track-type tractor is disclosed. The track-type tractor may comprise an engine, a frame supporting the engine, and a blade positioned at a front end of the tractor and configured to move a load. The track-type tractor may further comprise at least one hydraulic lift cylinder configured to raise and lower the blade. The hydraulic lift cylinder may include a cylinder barrel and a piston rod. The cylinder barrel may be connected to a backside of the blade, and the piston rod may be connected to a front end of the frame.

In accordance with another aspect of the present disclosure, a method of raising and lowering an implement of a track-type tractor with a hydraulic lift cylinder is disclosed. The hydraulic lift cylinder may include a head end, a rod end, and a cylinder barrel having a cavity that houses a piston. The cylinder barrel may include a first port in fluid communication with the cavity at the head end, and a second port in fluid communication with the cavity at a lower end of the cylinder barrel opposite the head end. The method may comprise raising the implement by flowing a hydraulic fluid into the cavity through the first port so that the hydraulic fluid applies head end pressure and causes the hydraulic lift cylinder to extend. The method may further comprise lowering the implement by flowing a hydraulic fluid into the cavity through the second port so that the hydraulic fluid applies rod end pressure and causes the hydraulic lift cylinder to contract.

These and other aspects and features of the present disclosure will be more readily understood when read in conjunction with the accompanying drawings.

DETAILED DESCRIPTION

Figure 1:
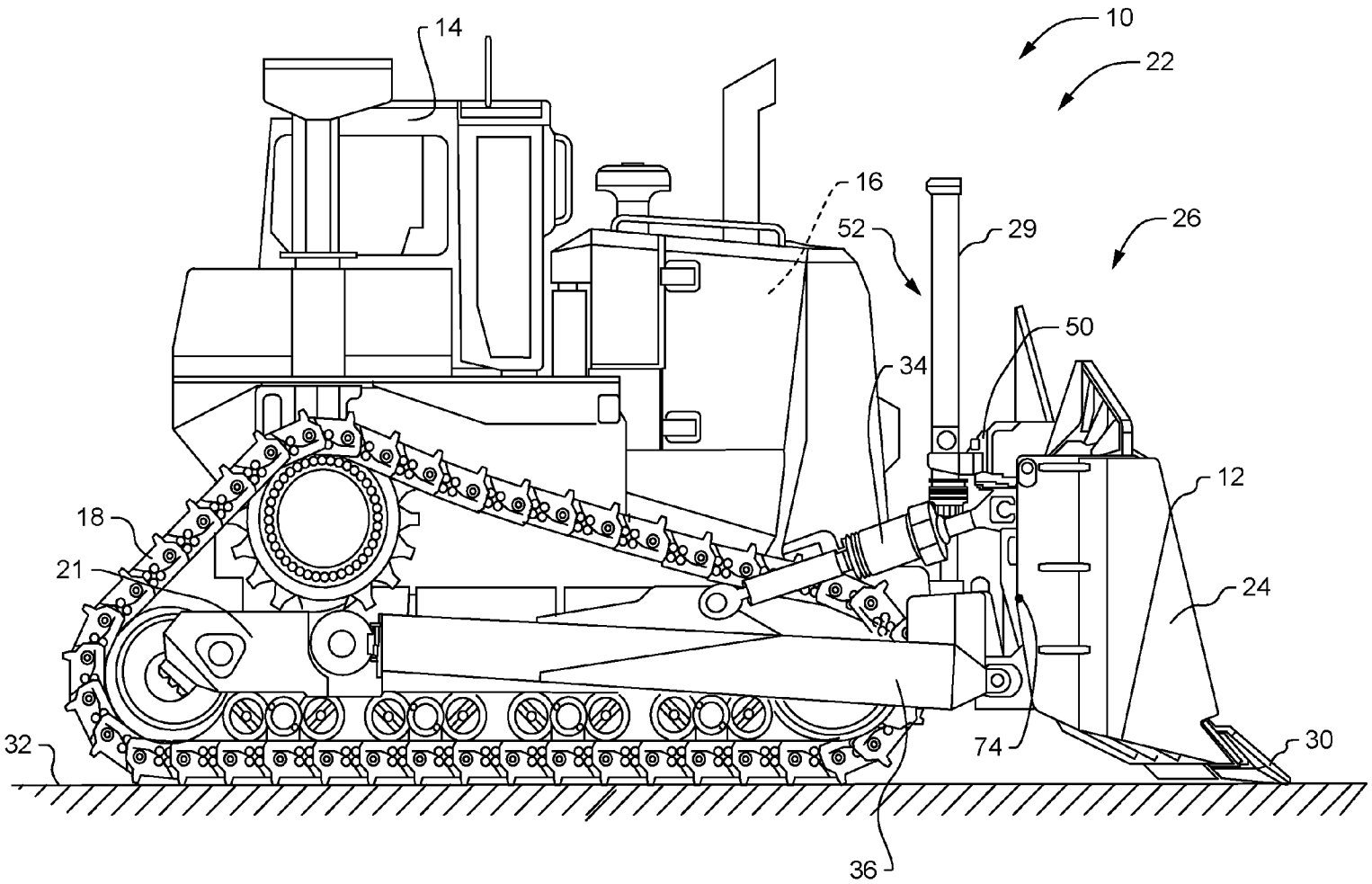
FIG. 1 is a side view of a track-type tractor having hydraulic lift cylinders for raising and lowering a blade, constructed in accordance with the present disclosure.
Figure 2:
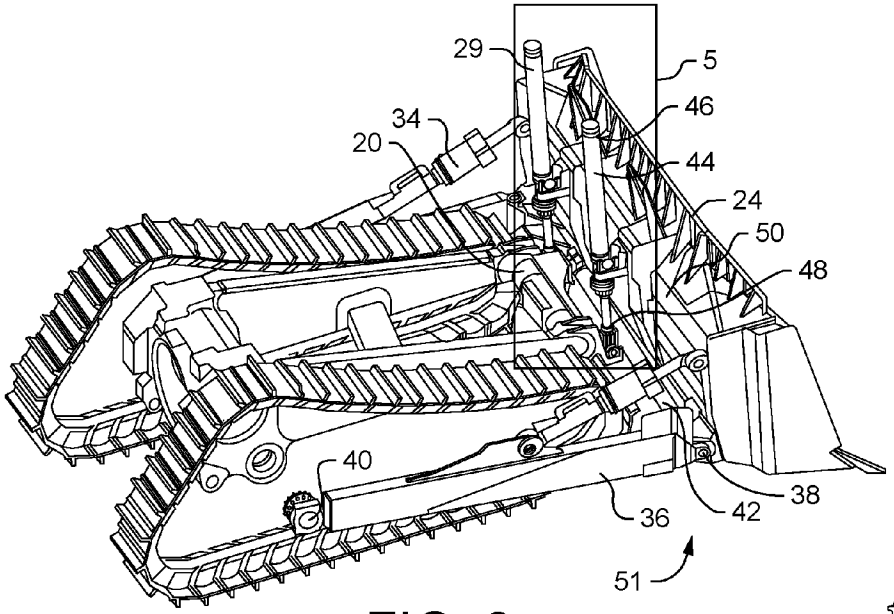
FIG. 2 is a top perspective view of the track-type tractor of FIG. 1 with the operator cab, engine, undercarriage, and portions of the frame removed for clarity, constructed in accordance with the present disclosure.

Referring now to the drawings, and with specific reference to FIGS. 1-2, a machine 10 having an implement 12 that moves a load such as soil, gravel, construction materials, or other objects is shown. The machine 10 may include an operator cab 14, an engine 16 that provides power to drive the machine 10 for movement via continuous tracks 18 or wheels, and a frame 20 (see FIG. 2) that supports the engine 16 and the cab 14. It may also include an undercarriage 21 that supports the tracks 18 (or wheels) and connects to the frame 20. Alternatively, the machine 10 may be an unmanned machine, in which case it may lack an operator cab and may be remotely controlled. As one possibility, the machine 10 may be a track-type tractor 22, such as a bulldozer, and the implement 12 may be a blade 24 on a front end 26 of the tractor that is raised and lowered as needed using one or more hydraulic lift cylinders 29. The blade 24 may have a cutting edge 30 that may be angled with respect to a ground surface 32 at an approach angle $\alpha$. The approach angle $\alpha$ may be at a minimum during digging and at a maximum for clearance when climbing a sloped ground surface. Although the present disclosure is described in connection with a track-type tractor, it will be understood that the concepts disclosed herein may be applied to other types of machines having an implement that is raised and lowered with one or more hydraulic lift cylinders.

Referring still to FIGS. 1-2, positioned on either side of the blade 24 may be a pair of hydraulic tilt cylinders 34 that extend and retract to adjust the side-to-side tilt angle and the forward to back tilt angle (or pitch) of the blade 24. As used herein, side-to-side tilting refers to laterally directed tilting with respect to the tractor, whereas forward to back tilting refers to forward to back tilting with respect to the direction of travel of the tractor.

On either side of the blade 24 may also be a pair of push arms 36 that connect the blade 24 to the tractor and accommodate tilting as well as raising and lowering of the blade 24. The blade 24 may be pivotably connected to the push arms 36 with connectors 38 that permit blade tilting, and the push arms 36 may be connected to the undercarriage 21 or frame 20 of the tractor with ball joints 40 that permit tilting and raising and lowering of the blade 24 (see FIG. 2). The track-type tractor 22 may also include a tag link 42 that holds the blade relatively centered with respect to the tractor as the blade 24 is tilted and loads are applied on the blade 24.

As shown in FIG. 2, two hydraulic lift cylinders 29 may actuate raising and lowering the blade 24 vertically with respect to the ground surface 32. In alternative arrangements, a single hydraulic lift cylinder or more than two hydraulic lift cylinders 29 may be used. Each of the hydraulic lift cylinders 29 may include a cylinder barrel 44, a head end 46, and a rod end 48. In contrast to current designs in which the cylinder barrels are mounted on an elevated support structure on the frame, the cylinder barrels 44 of the hydraulic lift cylinders 29 disclosed herein are mounted on a backside 50 of the blade 24. Moreover, in contrast to current designs in which the rod ends are attached low on the backside of the blade, the rod ends 48 of the hydraulic lift cylinders 29 disclosed herein are connected at a low position on a front end 51 the frame 20. As used herein, a low position on the frame refers to a position that is situated close to the ground surface 32 during operation of the machine.

Figure 3:
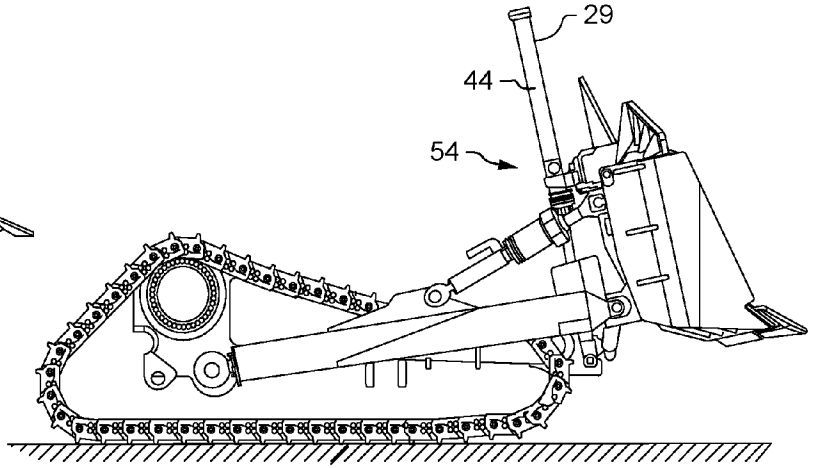
FIG. 3 is a side view similar to FIG. 2 with the blade raised and the hydraulic lift cylinders extended, constructed in accordance with the present disclosure.

By virtue of the mounting arrangement, the hydraulic lift cylinders 29 may lower the blade 24 by cylinder contraction 52 (rod end pressure) (see FIG. 1), and may raise the blade 24 by cylinder extension 54 (head end pressure) (see FIG. 3). Accordingly, the inherently greater force associated with head end pressure compared with rod end pressure may be advantageously leveraged when lifting the blade 24. Moreover, since the cylinder barrels 44 are connected to the backside 50 of the blade 24, the elevated support structure used to mount the cylinder barrels in current systems may be eliminated entirely or replaced with a substantially smaller and lighter cover piece, thereby facilitating engine access and reducing or eliminating the need for expensive high-level machined connections between the elevated support structure and the frame. In addition, loads may be transferred directly from the rod end 48 to the frame 20 via the mounting arrangement disclosed herein, rather than through a complex flow path through the elevated support structure to the frame as in current systems. Even further, the mounting arrangement disclosed herein may orient the hydraulic lift cylinders 29 more vertically on the machine compared with current mounting arrangements, such that the push arms 36 may be shortened and the blade 24 may be raised and lowered on a tighter radius. This may result in improved cutting edge penetration, as well as a reduced degree of cylinder extension needed to lift the blade 24 to a given height. Accordingly, the hydraulic lift cylinders 29 may be made significantly shorter at lower cost without compromising performance.

Figure 4:
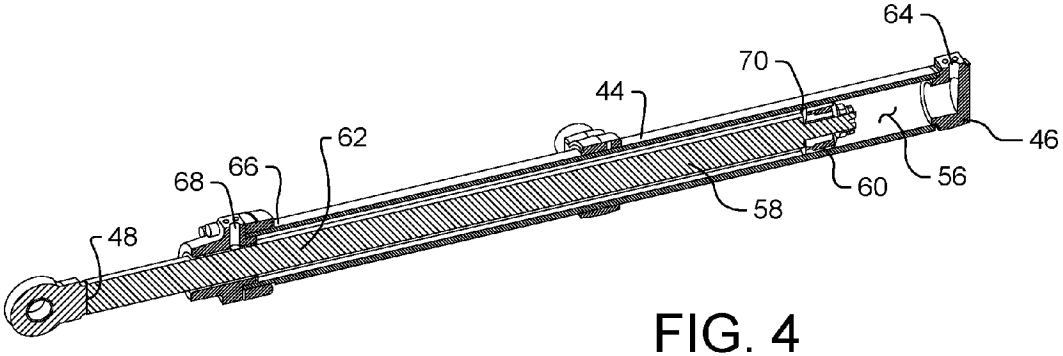
FIG. 4 is a cross-sectional view of one of the hydraulic lift cylinders shown in isolation, constructed in accordance with the present disclosure.

Turning now to FIG. 4, a single hydraulic lift cylinder 29 is shown in isolation. The cylinder barrel 44 may define a cavity 56 that houses a piston 58. The piston 58 may include a piston head 60 oriented toward the head end 46 of the cylinder 29, and a piston rod 62 that extends to the rod end 48 of the cylinder 29. At the head end 46 of the cylinder barrel 44 may be a first port 64 through which hydraulic fluid may flow into the cavity 56 to apply pressure (head end pressure) on the piston head 60 to cause cylinder extension 54 for raising the blade 24. At a lower end 66 of the cylinder barrel 44 opposite the head end 46 may be a second port 68 through which hydraulic fluid may flow into the cavity 56 to apply pressure (rod end pressure) on a lower lip 70 of the piston head 60 to cause cylinder contraction 52 for lowering the blade 24.

Figure 6:
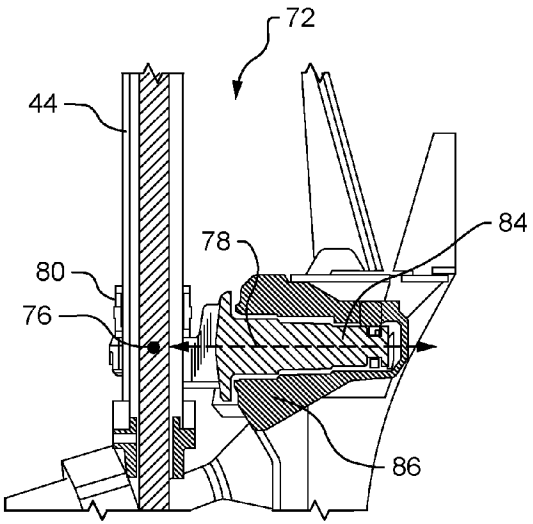
FIG. 6 is a cross sectional view through the section 6-6 of FIG. 5, constructed in accordance with the present disclosure.
Figure 5:
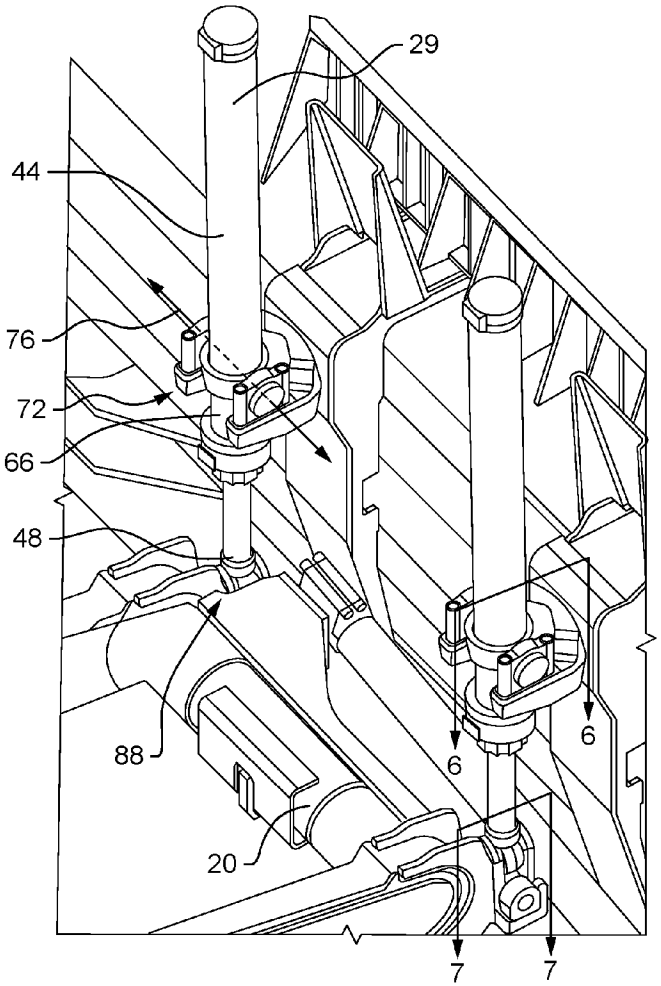
FIG. 5 is an expanded view of detail 5 of FIG. 2, illustrating the connection assemblies that mount the hydraulic lift cylinders to the blade and the frame of the track-type tractor, constructed in accordance with the present disclosure.
Figure 8:
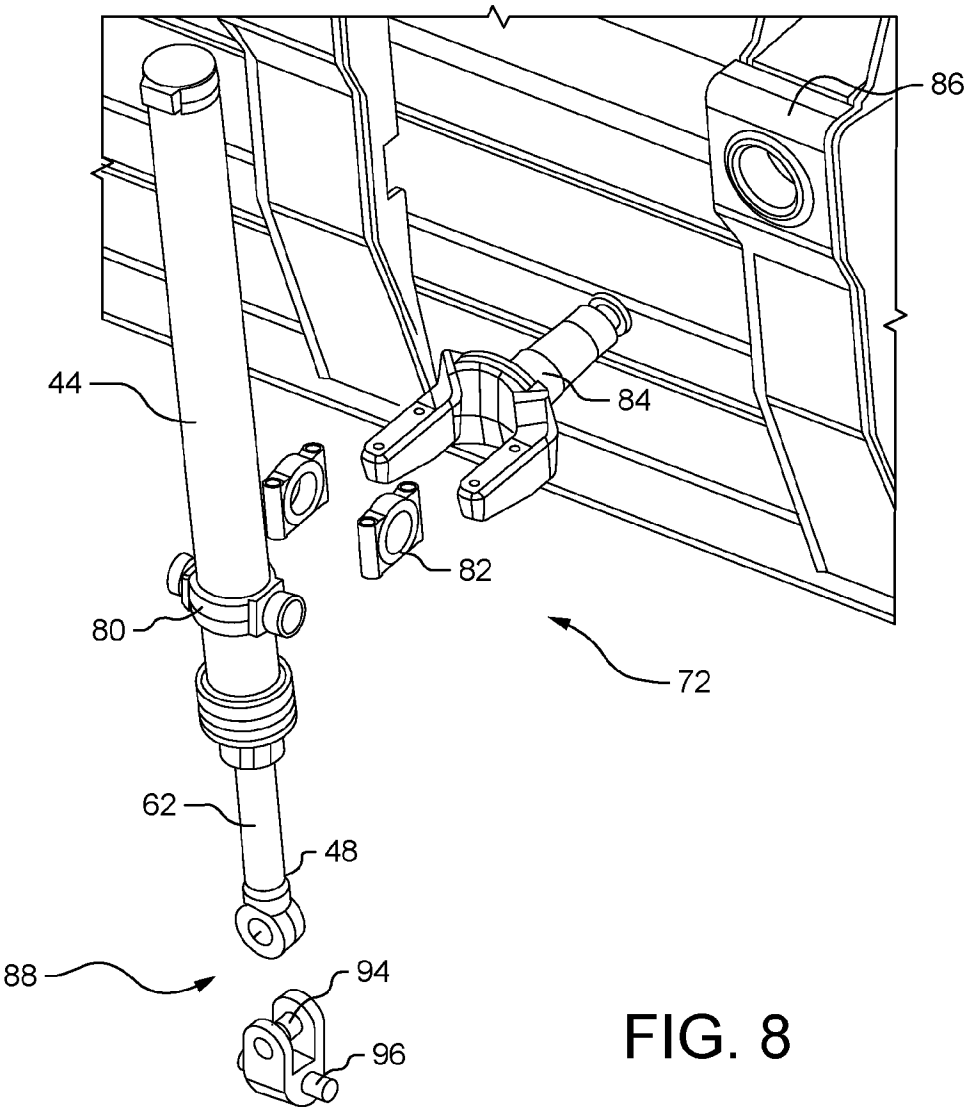
FIG. 8 is an exploded view of the connection assemblies of FIG. 5, constructed in accordance with the present disclosure.

As shown in FIGS. 5-6 and 8, a barrel connection assembly 72 may mount the cylinder barrel 44 to a position high on the backside 50 of the blade 24. As used herein, a position high on the backside 50 of the blade 24 refers to a vertical position that is above a midpoint 74 about halfway up the backside 50 of the blade 24 (see FIG. 1). However, in alternative arrangements, the cylinder barrel 44 may be mounted lower than the midpoint 74 of the blade. As a non-limiting possibility, the connection assembly 72 may connect the lower end 66 of the cylinder barrel 44 to the blade, although other positions of the cylinder barrel 44 may be connected to the backside 50 of the blade in alternative designs. The connection assembly 72 may be designed to accommodate movement of the blade 24 with respect to the hydraulic lift cylinder 29. Specifically, the connection assembly 72 may permit forward to back tilting of the blade 24 with respect to the hydraulic lift cylinder 29 on a first axis 76 (see FIGS. 5-6), as well as side-to-side tilting of the blade 24 with respect to the hydraulic lift cylinder 29 on a second axis 78 that is perpendicular to the first axis 76 (see FIG. 6).

As shown in the exploded view of FIG. 8, the connection assembly 72 may include a trunnion 80 fixedly attached (e.g., welded, bolted, etc.) to the cylinder barrel 44 that is rotatably connected to a set of bearings 82 to allow the forward to back tilting of the blade 24 with respect to the hydraulic lift cylinder 29 on the first axis 76. In addition, the connection assembly 72 may further include a yoke 84 fixedly attached (e.g., bolted, welded, etc.) to the bearings 82 and rotatably connected to a receiver 86 on the backside 50 of the blade 24. The rotatable connection between the yoke 84 and the receiver 86 may allow side-to-side tilting of the blade 24 with respect to the hydraulic lift cylinder 29 on the second axis 78. It will be understood that other alternative connection assemblies that permit forward to back and side-to-side tilting of the blade 24 with respect to the hydraulic lift cylinder 29 may also be used to mount the cylinder barrel to the backside of the blade without deviating from the scope of the present disclosure.

Figure 7:
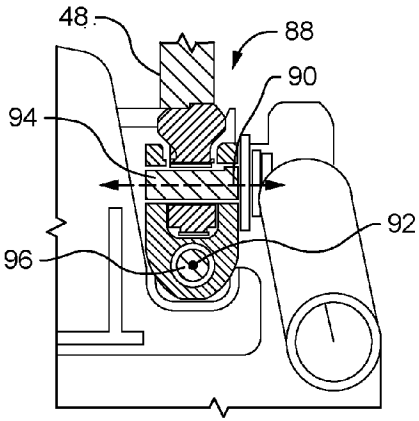
FIG. 7 is a cross-sectional view through the section 7-7 of FIG. 5, constructed in accordance with the present disclosure.

Referring now to FIGS. 5 and 7-8, a rod connection assembly 88 may connect the rod end 48 (i.e., the piston rod 62) of the hydraulic lift cylinder 29 to a low position on a front end of the frame 20. The rod connection assembly 88 may permit side-to-side pivoting of the hydraulic lift cylinder 29 on a third axis 90 that is parallel to the second axis 78 as needed to accommodate blade movement during operation of the tractor 22 (see FIG. 7). In addition, the rod connection assembly 88 may also permit forward to back pivoting of the hydraulic lift cylinder 29 on a fourth axis 92 that is perpendicular to the third axis 90 (and parallel to the first axis 76) as needed to accommodate blade movement (see FIG. 7). More specifically, as shown in FIGS. 7-8, a first pin connector 94 of the assembly 88 may define the third axis 90 on which the piston rod 62 may pivot from side-to-side, while a second pin connector 96 of the assembly may define the fourth axis 92 on which the piston rod 62 may pivot from forward to back.

Figure 10:
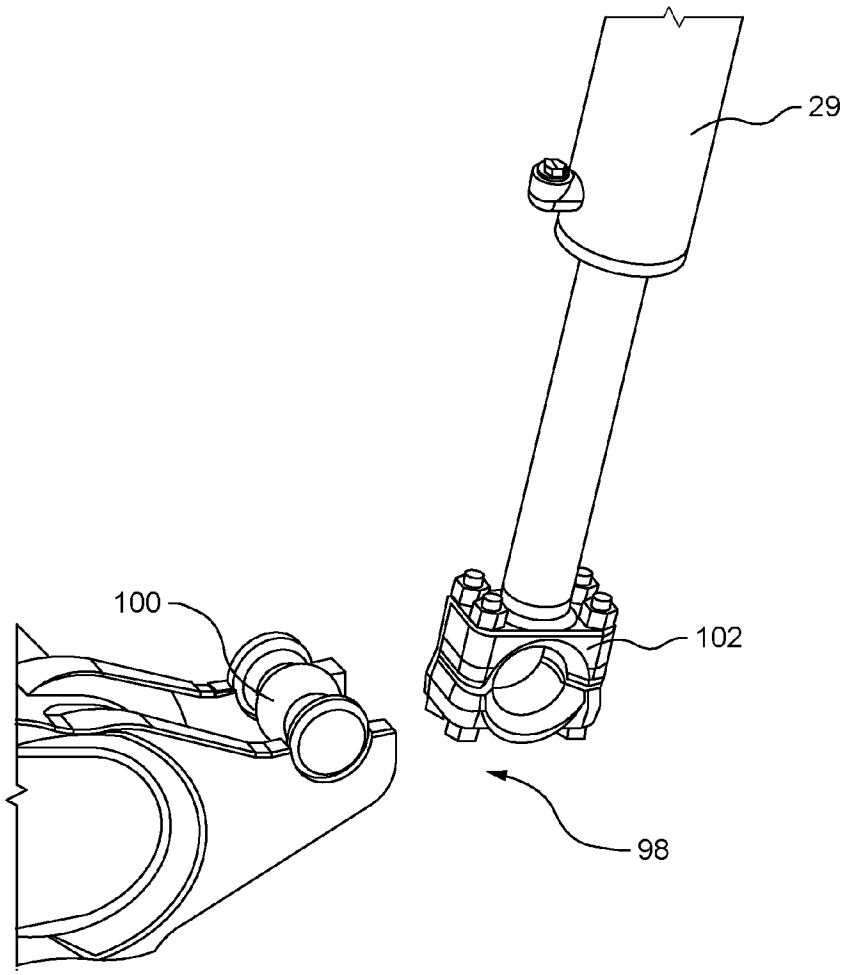
FIG. 10 is an exploded view of the ball joint connector of FIG. 10, constructed in accordance with the present disclosure.
Figure 9:
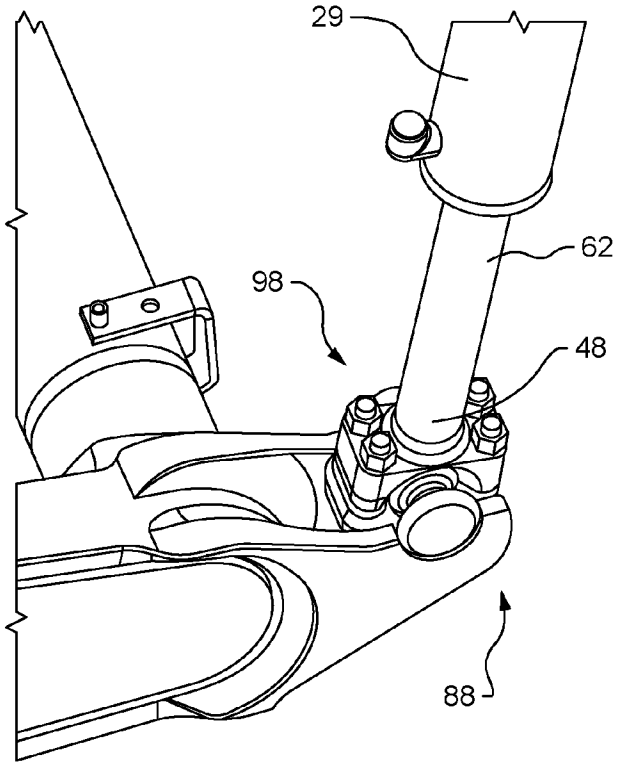
FIG. 9 is a perspective view of a ball joint connector between a rod end of a hydraulic lift cylinder and the frame of the track-type tractor, constructed in accordance with the present disclosure.

Alternatively, the rod connection assembly 88 may be a ball joint connector 98 as shown in FIGS. 9-10. The ball joint connector 98 may include a ball trunnion 100 received in a ball socket 102. Similar to the arrangement of FIGS. 5 and 7-8, the ball joint connector 98 may permit side-to-side and forward to back pivoting movement of the hydraulic lift cylinder 29 as needed to accommodate blade movement during operation of the tractor 22. Other alternative connection arrangements that permit such freedom of movement of the hydraulic lift cylinder 29 may also be used in place of the rod connection assemblies disclosed herein without deviating from the scope of the present disclosure.

INDUSTRIAL APPLICABILITY

In general, the teachings of the present disclosure may find applicability in many industries including, but not limited to, construction, agriculture, and mining industries. More specifically, the technology disclosed herein may find applicability in many types of machines that use hydraulic lift cylinders to raise and lower an implement including, but not limited to, track-type tractors such as bulldozers.

In operation, when it is desired to raise the blade 24 (or other implement), head end pressure may be applied to the hydraulic lift cylinders 29 by flowing hydraulic fluid into the cavity 56 of the cylinder barrel 44 through the first port 64 (see FIG. 4). The hydraulic fluid entering through the first port 64 may apply pressure to the piston head 60 and push the piston head 60 down in the cavity 56 of the cylinder barrel 44, causing hydraulic fluid to exit the cavity 56 through the second port 68. As a result, the hydraulic lift cylinder 29 may extend according to a block 120 and the blade may lift (see FIG. 3). Head end pressure may continue to be applied in this way until the blade 24 is raised to the desired level.

When it is desired to lower the blade 24, rod end pressure may be applied to the hydraulic lift cylinders 29 by flowing the hydraulic fluid into the cavity 56 of the cylinder barrel 44 through the second port 68 (see FIG. 4). The flow of the hydraulic fluid through the second port 68 may apply pressure to the lower lip 70 of the piston head 60 and push the piston head up through the cavity 56, causing hydraulic fluid to exit the cavity 56 through the first port 64. Accordingly, the hydraulic lift cylinder 29 may contract, causing the blade to lower (see FIG. 1). Rod end pressure may continue to be applied until the blade 24 is lowered to the desired level.

Thus, it can be seen that the hydraulic lift cylinder mounting arrangement of the present disclosure allows the higher capacity associated with head end pressure/cylinder extension to be leveraged for lifting the blade, and specifically during pryout. Rod end pressure (cylinder contraction) will be more than sufficient for lowering the blade and digging. Thus, hydraulic pumps and associated components that control the flow of hydraulic fluid may even be downsized. Furthermore, mounting the hydraulic lift cylinders on the backside of the blade and to the frame eliminates the need for a large elevated support structure on the frame, as well as the need for associated high-level machined connections between the elevated support structure and the frame. In the hydraulic lift cylinder mounting arrangement disclosed herein, loads are transferred directly from the piston rods to the frame, such that the radiator guard and engine enclosure may not experience loads apart from machine vibration. Accordingly, the radiator guard and engine enclosure may be a lighter fabrication. Moreover, the mounting arrangement draws the blade closer to the machine which leads to an improvement in cutting edge penetration and productivity. As the hydraulic lift cylinders are oriented more vertically, the blade may be raised and lowered on a tighter radius. As a result, less cylinder extension is required to lift the blade to a given height. Accordingly, the hydraulic lift cylinders may be made significantly shorter to further reduce costs and facilitate shipping. The technology disclosed herein provides a number of benefits over the current hydraulic lift cylinder mounting arrangements, and may find wide industrial applicability in a wide range of areas such as, but not limited to, construction, road construction, mining, and agriculture applications.

What is claimed is:

1. A track-type tractor, comprising:

an operator cab;

an engine;

a frame supporting the operator cab and the engine;

a blade configured to move a load; and at least one hydraulic lift cylinder configured to raise and lower the blade, the hydraulic lift cylinder including a head end, a rod end, and a cylinder barrel, the cylinder barrel being mounted to a backside of the blade at a location between the head end and the rod end, the rod end being connected to the frame.

2. The track-type tractor of claim 1, wherein the hydraulic lift cylinder raises the blade by cylinder extension, and lowers the blade by cylinder contraction.

3. The track-type tractor of claim 1, wherein the track-type tractor is a bulldozer.

4. The track-type tractor of claim 1, wherein the cylinder barrel is mounted to the backside of the blade with a barrel connection assembly, the barrel connection assembly being configured to permit forward to back tilting of the blade with respect to the hydraulic lift cylinder on a first axis, the barrel connection assembly being further configured to permit side-to-side tilting of the blade with respect to the hydraulic lift cylinder on a second axis that is perpendicular to the first axis.

5. The track-type tractor of claim 4, wherein the rod end is connected to the frame with a rod connection assembly, the rod connection assembly being configured to permit side-to-side pivoting of the hydraulic lift cylinder on a third axis that is parallel to the second axis, the rod connection assembly being further configured to permit forward to back pivoting of the hydraulic lift cylinder on a fourth axis that is parallel to the first axis.

6. The track-type tractor of claim 1, wherein the cylinder barrel is mounted to the backside of the blade with a barrel connection assembly, the barrel connection assembly including a trunnion fixedly attached to the cylinder barrel, the trunnion being rotatably connected to a set of bearings, the rotatable connection between the trunnion and the bearings permitting forward to back tilting of the blade with respect to the hydraulic lift cylinder on a first axis.

7. The track-type tractor of claim 6, wherein the barrel connection assembly further includes a yoke fixedly attached to the bearings and rotatably connected to the backside of the blade, the rotatable connection between the yoke and the backside of the blade permitting side-to-side tilting of the blade with respect to the hydraulic lift cylinder on a second axis that is perpendicular to the first axis.

8. The track-type tractor of claim 7, wherein the rod end is connected to the frame with a rod connection assembly, the rod connection assembly being configured to permit side-to-side pivoting of the hydraulic lift cylinder on a third axis that is parallel to the second axis, the rod connection assembly being further configured to permit forward to back pivoting of the hydraulic lift cylinder on a fourth axis that is parallel to the first axis.

9. The track-type tractor of claim 8, wherein the rod connection assembly includes a first pin connector defining the third axis on which the hydraulic lift cylinder pivots from side-to-side, and a second pin connector defining the fourth axis on which the hydraulic lift cylinder pivots from forward to back.

10. The track-type tractor of claim 8, wherein the rod connection assembly is a ball joint connector.

11. A track-type tractor, comprising:

an engine;

a frame supporting the engine;

a blade positioned at a front end of the tractor and configured to move a load; and at least one hydraulic lift cylinder configured to raise and lower the blade, the hydraulic lift cylinder including a head end, a rod end, and a cylinder barrel, the cylinder barrel being mounted to a backside of the blade at a location between the head end and the rod end, the rod end being connected to a front end of the frame.

12. The track-type tractor of claim 11, wherein the hydraulic lift cylinder raises the blade by cylinder extension and lowers the blade by cylinder contraction.

13. The track-type tractor of claim 12, wherein the cylinder barrel includes a lower end opposite the head end, the cylinder barrel defining a cavity housing a piston having a piston head oriented toward the head end, the lower end of the cylinder barrel being connected to the backside of the blade.

14. The track-type tractor of claim 12, wherein the cylinder barrel is connected to the backside of the blade with a barrel connection assembly, the barrel connection assembly being configured to permit forward to back tilting of the blade with respect to the hydraulic lift cylinder on a first axis, the barrel connection assembly being further configured to permit side-to-side tilting of the blade with respect to the hydraulic lift cylinder on a second axis that is perpendicular to the first axis.

15. The track-type tractor of claim 14, wherein the barrel connection assembly includes a trunnion fixedly attached to the cylinder barrel, the trunnion being rotatably connected to a set of bearings that permit the forward to back tilting of the blade with respect to the hydraulic lift cylinder on the first axis.

16. The track-type tractor of claim 15, wherein the barrel connection assembly further includes a yoke fixedly attached to the bearings, the yoke being rotatably connected to the backside of the blade, the rotatable connection between the yoke and the backside of the blade permitting the side-to-side tilting of the blade with respect to the hydraulic lift cylinder on the second axis.

17. The track-type tractor of claim 16, wherein the rod end is connected to the front end of the frame with a rod connection assembly, the rod connection assembly being configured to permit side-to-side pivoting of the hydraulic lift cylinder on a third axis that is parallel to the second axis, the rod connection assembly being further configured to permit forward to back pivoting of the hydraulic lift cylinder on a fourth axis that is parallel to the first axis.

18. The track-type tractor of claim 17, wherein the rod connection assembly includes a first pin connector defining the third axis on which the hydraulic lift cylinder pivots from side-to-side, and a second pin connector defining the fourth axis on which the hydraulic lift cylinder pivots from forward to back.

19. The track-type tractor of claim 17, wherein the rod connection assembly includes a ball joint connector.

20. A track-type tractor, comprising:

an engine;

a frame supporting the engine;

an implement configured to move a load; and at least one hydraulic lift cylinder configured to raise and lower the implement, the hydraulic lift cylinder including a head end, a rod end, and a cylinder barrel extending between the rod end and the cylinder barrel, the cylinder barrel being mounted to a backside of the implement at a location between the head end and the rod end, the rod end being connected to the frame.

* * * * *